United States Patent [19]

Anania, Sr.

[11] 4,018,445

[45] Apr. 19, 1977

[54] EDUCATIONAL PUZZLE GAME

[76] Inventor: James A. Anania, Sr., 801 N. 6th St., No. 716, P.O. Box 186, Newark, N.J. 07107

[22] Filed: Sept. 26, 1975

[21] Appl. No.: 617,100

Related U.S. Application Data

[63] Continuation-in-part of Ser. No. 577,233, May 14, 1975, Pat. No. 3,967,825.

[52] U.S. Cl. ..... 273/135 B; 273/130 C; 273/136 B; 273/136 C; 273/136 K

[51] Int. Cl.[2] ..... A63F 3/06

[58] Field of Search ..... 273/135 R, 135 B, 135 BC, 273/135 AC, 135 AD, 130 R, 130 A, 130 C, 134 E, 136 B, 141 R, 156, 153 R, 132, 136 K, 135 D, 136 C, 136 D, 136 E, 136 G, 136 K, 144 A

[56] References Cited

UNITED STATES PATENTS

| | | | |
|---|---|---|---|
| 875,230 | 12/1907 | Youngman | 273/135 R |
| 1,513,500 | 10/1924 | Greig | 273/141 R |
| 2,594,434 | 4/1952 | Hofsetz | 273/144 A |
| 3,445,115 | 5/1969 | Hunter | 273/135 AC |
| 3,625,514 | 12/1971 | Haalano | 273/136 C |

FOREIGN PATENTS OR APPLICATIONS

| | | | |
|---|---|---|---|
| 503,955 | 4/1939 | United Kingdom | 273/136 K |
| 594,725 | 11/1947 | United Kingdom | 273/130 C |

OTHER PUBLICATIONS

Regal Games Mfg. Co., Ad.

*Primary Examiner*—Richard C. Pinkham
*Assistant Examiner*—Harry G. Strappello
*Attorney, Agent, or Firm*—Lowe, King, Price & Markva

[57] ABSTRACT

An educational game for playing a game of skill and judgment, the game comprising, at least one game board divided into a plurality of rows and columns of four in number, a plurality of numbered tokens for placing at each of the sixteen spaces defined on the game board by the rows and columns, each of said game boards having a numerical solution, the solution being 38 as obtained by addition of the numbered tokens on the board after all spaces are filled, the addition being in any desired direction of any four of the tokens in abutting relationship or in squares. In playing the game, numerical tokens are selected and placed on the game board until all spaces on each player's board are filled, the object of the game being to obtain the correct solution indicated for that particular game. Optionally, random number selector means may be used to select the order of playing the numbered tokens.

10 Claims, 7 Drawing Figures

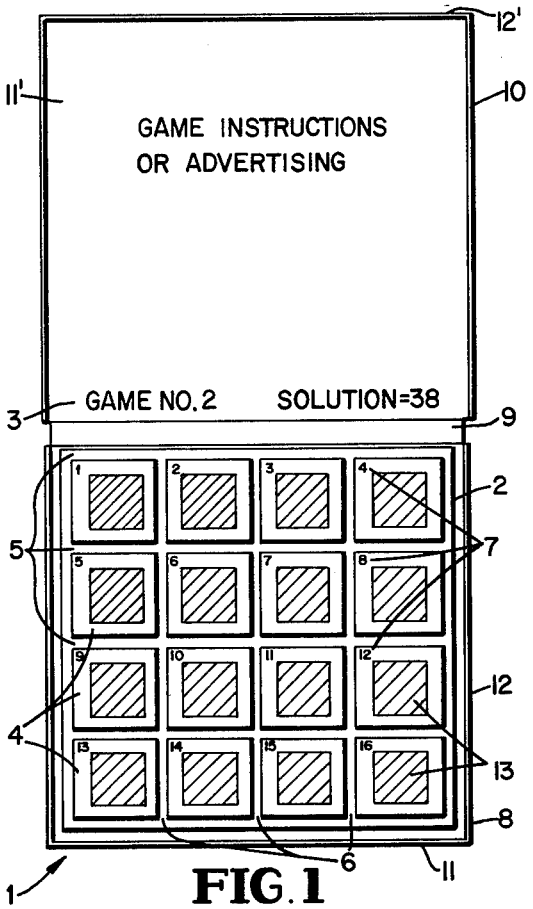
FIG. 1
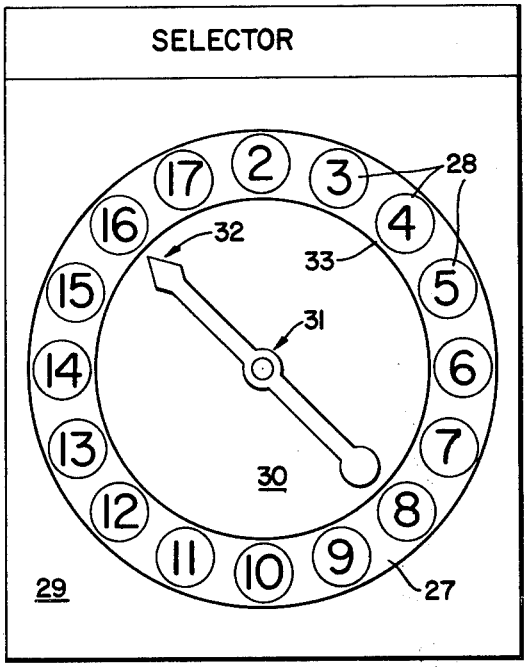
FIG. 3
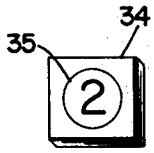
FIG. 4
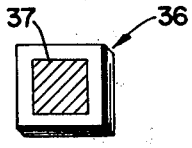
FIG. 5
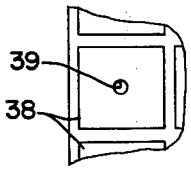
FIG. 6
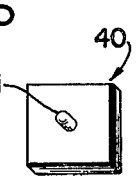
FIG. 7
FIG. 2
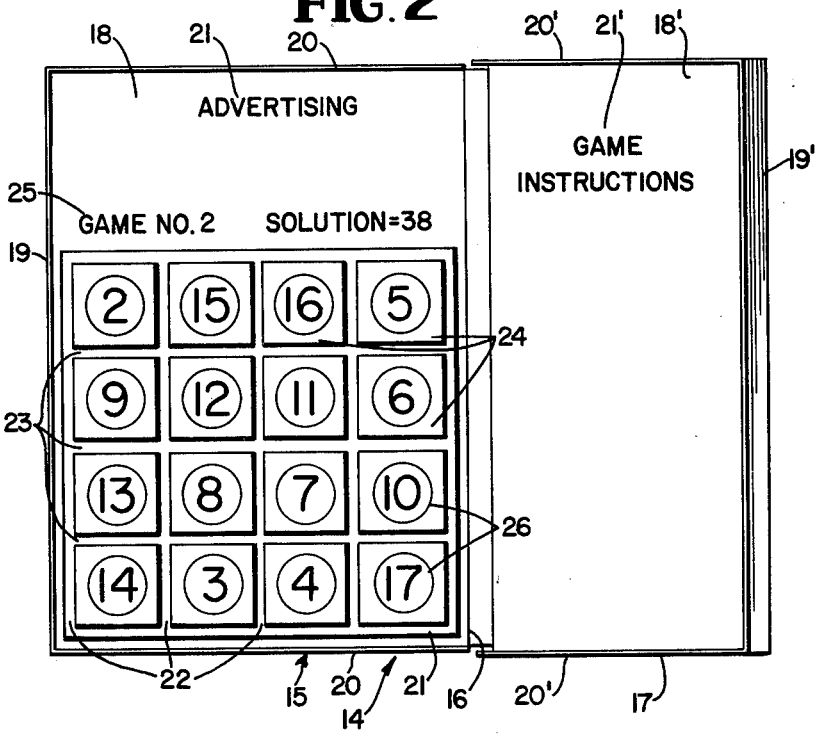

EDUCATIONAL PUZZLE GAME

CROSS REFERENCE TO RELATED APPLICATIONS

This is a continuation-in-part of my application Ser. No. 577,233, filed May 14, 1975 now U.S. Pat. No. 3,967,825.

BACKGROUND OF THE INVENTION

1. Field of the Invention

This invention relates to a recreational device and more particularly to an educational game which makes use of mathematical computations and skill to arrive at indicated numerical solutions on game boards.

2. Description of the Prior Art

Various types of numerical games are known to the prior art using a plurality of numbered pieces selectively placed on a given game board in a certain order to indicate one's skill or educational level. Usually prior art devices of this type are used to indicate one's skill in multiplication and subtraction or the like but are not operable in a manner requiring one to foresee the innumerable combinations of present and future plays to pit one player's skill against another player's skill. Usually the prior art will be found to fall into two categories. One category comprises bingo-like games wherein the player has a card having rows and columns thereon to define a plurality of spaces. Each of the spaces has a number printed thereon and as the leader of the game calls these numbers in a random order, the player of the game marks those numbers he finds on his card. When the player completes a row or column or diagonal of such markings and he is the first to do so, he is the winner of the game.

This type of game is characterized by the fact that the numbers are already placed on the card, thus no skill is really employed in choosing of numbers or placement of numbers. Accordingly, in another class of numerical game boards, rows and columns are delineated to form related spaces and the player has available to him a plurality of numbers and/or mathematical symbols usually with some information preprinted upon the board either in some of the spaces or along the edges. The player then employs his numbers and/or symbols to form equations and the like. Sometimes an opponent plays upon the same board and employs numbers or indicia already placed upon the board by the first player so that the opponent can form his own equations for his scoring. In such games, the players have a plurality of numbers and/or indicia from which they can select before making their play. The present invention is a new and challenging game of the latter type.

SUMMARY OF THE INVENTION

It is accordingly one object of this invention to provide an educational game requiring skill and judgement to win the game.

A further object of the invention is to provide an educational game wherein the skill of the player is utilized to select given numbers and then place these numbers in the correct spaces on a game board in order to arrive at the correct numerical solution for the game.

Other objects and advantages of the present invention will become apparent as the description thereof proceeds.

In satisfaction of the foregoing objects and advantages there is provided by this invention an educational game requiring judgement and skill to become a winner by arriving at the correct numerical solution of 38, said game comprising:

a. a playing surface containing a game board, said game board being divided by rows and columns of four in number into sixteen spaces, each of said spaces being adapted to receive tokens;

b. means for lateral and longitudinal movement of said tokens;

c. means for causing said tokens to stay in the space selected;

d. means adapted to select a numbered token which contains numbers thereon ranging from 2–17;

e. a plurality of numbered token means, said numbers being consecutive numbers from 2–17;

wherein the player selects numbered tokens and places one of said tokens on one space of said game board and whereby the numbers must be placed on the game board in such manner as to provide the numerical solution 38 indicated on the game board when the numbers are added in all 16 directions, in each row, in each column, in each diagonal, or of any four numbers in a square.

BRIEF DESCRIPTION OF THE DRAWING

Reference is now made to the drawings accompanying this application wherein;

FIG. 1 shows one embodiment of a game board for the game of the invention prior to placing the numerical tokens thereon;

FIG. 2 shows a second embodiment of a game board of the invention containing the numerical tokens inserted thereon in the proper order to give the correct solution to the game;

FIG. 3 shows a random selector means and disc means which is an optical embodiment for selecting the numbers for the game;

FIG. 4 is a perspective view of one embodiment of a numbered token for use in the game;

FIG. 5 is a rear perspective view of the token of FIG. 4 and shows one embodiment for attaching the numbered tokens to spaces on the game board;

FIG. 6 is a front perspective view in section of a second embodiment for attaching the numbered tokens to spaces on the game board; and FIG. 7 is a rear perspective view of a token for attachment to the game board using the embodiment of FIG. 6.

DESCRIPTION OF THE PREFERRED EMBODIMENTS

As indicated above, this invention is concerned with an educational game in which the object is for each player to arrive at the correct numerical solution for the game in the earliest possible time. The game is properly described as a Multiplicator Puzzle Game.

A general concept and description of a game of this type is described and claimed in my above-mentioned U.S. Pat. application Ser. No. 577,233, filed May 14, 1975 now U.S. Pat. No. 3,967,825, and the disclosure of my parent application is expressly incorporated herein by reference. The present invention is directed to additional and distinct specific embodiments of the concept of the invention described in my parent application.

As described in my parent application, the game generally comprises a playing surface or game board divided by rows and columns into 16 spaces on which numbered tokens are inserted in order. The order of insertion of the numbered tokens may be determined as desired and in one aspect, the order may be determined by use of a random selector means on which is placed a particular disc for that game. The disc is provided with numbers which have been arranged so that proper selection will result in the numerical solution to the game. The numbered tokens correspond in number to the spaces on the playing surface and to the numbers on each disc. The total invention in my parent application comprises a plurality of games with four separate games illustrated in my parent application as Games 3, 4, 5 and 6, the numbers of the games being derived from the last digit of the diagonal on each game board. The present invention covers an additional game and additional embodiments thereof. The game may be played by one, two or more players and may be played by each player selecting a game which will provide the same solution or by selecting games which will provide different solutions.

As will be appreciated, the game is a game of skill which requires the proper placing of the numbered tokens so that addition in any direction will result in the correct numerical solution of the game. It requires the player to exercise that judgement necessary to place the numbered token in the correct space in order to arrive at the particular numerical solution and the first player to reach the correct solution to his game is the winner.

Reference is now made to the drawings accompanying this application wherein like numerals represent like objects and wherein are set forth specific elements and embodiments of the game and which also indicate the method by which the game is played together with the numbers to be placed on the tokens and the numerical solution to the game.

In the drawings, FIG. 1 generally shows one embodiment of a game board including container means for the tokens and the playing or game board. FIG. 2 generally shows a different embodiment of the game board of FIG. 1 with the tokens in proper position. FIG. 3 shows a random selector means with a selector disc mounted thereon which is optional in selecting the numbers. FIG. 4 shows a specific token means for use in the game; and FIG. 5 shows one embodiment for attaching the token to the game board space. FIGS. 6 and 7 represent different embodiments for attaching a token to a game board space.

Referring now to FIG. 1, there is shown a game board having a planar playing surface for placement of the tokens thereon in the proper order. Also provided is a hinged container means for the board surface and numbered tokens.

In FIG. 1, the game is set-up with game board 1 and the surface 2 for insertion of tokens in the proper sequence. The game being played and solution for that game, in this case Game No. 2, Solution 38, may be indicated by printing in the margin or border or other desired area 3. The surface of each game board is divided into sixteen substantially equal sections 4, the division being made by rows and columns by use of longitudinal markings 5, and horizontal markings 6. By use of these markings, the game surface is divided into a total of 16 separate areas 4. The playing areas 4 may be squares, circles, rectangles or any desired shape. Each of these areas is further numbered by small numeral indicia 7 from 1 to 16 in the upper left-hand corner.

The playing surface of each game board is preferably a substantially planar material and may be wood, paper, cardboard or synthetic polymer composition material. The longitudinal and lateral markings which divide the board into a plurality of rows and columns intersect each other to define the plurality of spaces numbered 1 to 16. The longitudinal and lateral markings may be formed on the game board by any convenient or conventional means. Thus, when the game board is wood, paper or cardboard, the markings can be printed upon the top surface of the game board and when the game board is of wood or synthetic polymer composition material, the markings can be formed by raising or depressing below the general surface thereof. In one embodiment, the markings may be raised so as to leave the spaces 4 as slightly recessed spaces to receive the tokens.

In the particular embodiment of FIG. 1, the game 1 is constructed of a planar surface 2 which may have a border completely circumscribing the surface 2. The border may be raised so as to cause the playing surface 2 to be completely or slightly recessed. In the embodiment of FIG. 1, the playing surface 2 is contained within a hinged box comprising a bottom portion 8 containing the playing surface 2, hinged section 9 and top or cover portion 10. The bottom and top are substantially identical and comprise flat portions 11 and 11' defined by sides 12 and 12'. The top and bottom are constructed so that when the top 10 is folded over bottom portion 8 by means of hinge portion 9 the top and sides completely encase the bottom. The playing board is attached to the bottom portion surface 11 as by glue. The hinged box may be constructed of paper, wood, cardboard, plastic or the like. The logo or other information, advertising or game instructions may be placed in flat surface 11' of the top or cover or may be placed on the outside of the box as desired.

In FIG. 1, each of the numbered squares 4 are further provided with magnets 13 which are preferably adhesively secured to each of squares 4. These magnets 13 are preferably slightly smaller than the playing square 4 and are adapted to attract and retain an unlike polar magnet attached to the back of a numerical token. A token of this type will be described in the discussion of FIG. 5. The magnet may be of the same or different shape as area 4. However, in the most preferred embodiment, area 4 is a 1¼]inches square and magnet 13 is a very thin 1 inch square magnet.

In FIG. 2 the game board is contained within a hinged book-type container or box 14. As seen in FIG. 2, container 14 comprises bottom portion 15, hinged or bound portion 16 and top or cover portion 17. Each of said bottom and top portion 15 and 17 comprises planar surfaces 18 and 18', the planar surfaces being defined by lateral sides 19 and 19' and ends 20 and 20', respectively. The playing surface or game board 21 is adhesively attached to the planar surface 18 of bottom 15. The hinge means 16 may be of any desired conventional hinge including a single book-binding hinge, paper or cardboard fold or the like. Generally, any type of hinge or fold as known in the book binding art may be used as the result is to be a container or box in the shape and appearance of a book. In that regard, when the top is folded over the bottom, a book-like container will result.

The container may be constructed of paper, cardboard, wood, plastic or any similar material. The logo, or other information or advertising or game instructions may be placed on the flat surface 21 and 21' of the bottom or top or on the outside of the book-like container.

The game board 21 of FIG. 2 is generally the same as FIG. 1 except that it is illustrated in a different container means as described, and further the game board surface is shown as having the numbered tokens placed thereon to provide the proper solution for the game, and thus the board is the same as FIG. 1 except for the container, indicia, and tokens placed thereon. In FIG. 2, game board 21 is indicated as having been divided by longitudinal markings 22 and lateral markings 23 into sixteen spaces 24 as discussed for FIG. 1. The game board or surface may also carry the identifying indicia and point solution 25 in bottom surface 18. The game board is further shown as having the numbered tokens 26 placed in each of the spaces in this game. In the game the numbered tokens 26 placed as shown in this drawing indicate the numerical solution to the game. The solution may be arrived at by adding the numbers on the tokens in each of the squares in the horizontal direction of any row, in the vertical direction of any column, in either diagonal direction or by addition of the numbers of any square formed by the tokens. Thus, to illustrate, the addition of the numbered tokens in squares 1, 2, 3 and 4 provide a solution of 38 points. Addition of the numbers in vertical columns 1, 5, 9 and 13 also provide the solution of 38 points. Further, addition of the numbers in the square in the lower left-hand corner identified by the numbers 9, 10, 13 and 14 provides the solution of 38 points. When the tokens are placed as shown, the correct solution to the game has been obtained.

As an alternative embodiment, means may be provided to select the order of numerical tokens to be played. This is especially useful where two or more players are playing. Thus, in this embodiment, with the game board, there may be provided an appropriate disc and selector to be used for the game. A suitable disc and selector are shown in FIG. 3 and comprise generally a circular disc structure 27 of cardboard, paper, wood or the like having numbers 28 printed or otherwise placed thereon in the appropriate order. As will be noted, the disc contains consecutive numbers 2 to 17 spaced generally evenly about the circle.

The random numeral selection means is indicated generally in FIG. 3 by reference numeral 29 and generally comprises a base 30 having a spinner 31 thereon, the spinner 31 having an indicating pointer 32 on one end thereof. The base 30 is also provided with a generally recessed circular portion 33 so that the circular disc 27 can be mounted on the random selector spinner means. The disc is adapted to be placed onto the selector means 29, preferably by insertion into the recessed portion indicated at 33. The disc 27 is provided with substantially evenly spaced numbers 28 and these numbers are selected by the random selector after mounting of the disc thereon. The numbers on each disc are those numbers which when inserted in the proper order on the game board will provide the numerical solution.

Reference is now made to FIG. 4 which shows one embodiment of a numbered token utilized in the game of this invention. As indicated in FIG. 4, the numbered token 34 is generally square and carries a number 35 thereon, in this case the number 2. The token 34 is preferably square, but may be of any desired shape such as circular or rectangular. It is preferably a small 1¼ inches wood or plastic square or disc having a thickness of about one-eighth to three-eighths inch and having the appropriate number printed, indented or raised thereon. The numbered token 34 is used by the player to insert in the various spaces on the game board or playing surface. As to shape, the token 34 should be generally of the same shape as spaces 4 shown in FIG. 1.

In FIG. 5 there is shown a reverse view of a numerical token such as the token of FIG. 4, this view particularly showing a means of attachment of the numerical token in accordance with the embodiment shown in FIG. 1. Thus, in FIG. 5, there is shown generally a token 36 which has a magnet 37 attached thereto such as by adhesive means. The magnet 37 generally corresponds to magnets 13 as shown in FIG. 1 except that it has the opposite pole and is designed so that when a token constructed in accordance with FIG. 5 is played in one of the squares of FIG. 1 the magnets will attract and once played, the token will remain in place.

In FIGS. 6 and 7, there are shown other embodiments by which the numerical tokens may be attached or may remain adhered to playing spaces such as spaces 4 of FIG. 1. Shown in section in FIG. 6 is a portion of the game board showing a single square 38 which corresponds generally to the squares 4 of FIG. 1, but wherein attachment of the token is by a male and female peg means. In this embodiment, in FIG. 6 a recessed portion or hole 39 is provided to receive the male portion of a peg which would be contained on the reverse side of a token. A token 40 of this type is shown in FIG. 7 which on its reverse side contains a small circular peg means 41 which is adapted to fit within the recess 39 in the playing square of FIG. 6. Therefore, by placing the peg 41 within the hole 39 in playing the token, the token will remain on the playing board.

While magnet means and male and female peg means have been illustrated in FIGS. 5, 6 and 7 as preferred means by which the numerical tokens may be caused to remain attached to the space in which it is played it is quite obvious that other methods may of course be used including recesses, adhesive means and the like. Similarly, if desired, the tokens may be merely placed on the playing squares.

As indicated herein, either the embodiment of FIG. 1 or the embodiment of FIG. 2 may be utilized as the container for the game board used in playing the game. The major difference between these embodiments resides in the particular container in which the game board is placed. Using the magnet or peg means of FIGS. 1, 5, 6 and 7, the containers are also adapted to store the tokens. Thus, in the preferred embodiments, the tokens are stored on the playing board by means of the magnets, pegs or the like.

As indicated hereinabove the game is played by selecting one of the numerical tokens and placing it in the appropriate square and continuing to select tokens and playing them until the ultimate solution to the game is obtained. For this particular game, the solution is as shown in FIG. 2 as this arrangement of the playing tokens will result in the solution to the game, in this case the number 38. The number 38 may be derived by addition of any four squares of any four numbers in a row, either laterally, longitudinally or diagonally as described above.

In one embodiment for playing the game, use may be made of the random number selector of FIG. 3 in which case before playing each token, the player would operate the random selector spinner to determine the number to be played. On determination of the number, he would then insert the numerical token in any position or space desired. As illustrated in FIG. 3, if the pointer should stop at number 16 as indicated, the token bearing this number should be placed in the appropriate space. As shown in FIG. 2, the proper space for the numerical number 16 would be in space number 3. When the player has arranged his tokens to provide the numbers shown in FIG. 2, he will have arrived at the proper solution to the puzzle or game and will have won. It is obvious that the first space selected by the player may not necessarily be the space at which he will ultimately desire to place the numbered token. It will be apparent that as play proceeds and as more tokens are obtained, the numerical tokens will have to be moved from space to space in order to arrive at the correct solution. Thus, the game combines skill, luck and ingenuity to arrive at the correct solution.

The invention has been described herein by reference to certain preferred embodiments. However, as obvious variations thereon will become apparent to those skilled in the art, the invention is not to be considered as limited thereto.

What is claimed is:

1. An educational game comprising:

a. a game board, said game board being divided by rows and columns of four in number and divided into sixteen spaces, said game board being disposed with container means comprising a hinged cover which folds over and covers said game board contained in the bottom portion of said container;

b. said game board having indicated thereon a numerical solution of 38, c. said sixteen spaces of said game board being sequentially numbered from one to sixteen and each of said spaces being adapted to receive numbered tokens thereon, d. a total of sixteen numbered tokens, each of said tokens having affixed thereon a single number, said numbers being consecutive numbers from two to seventeen, e. random selection means to select a numbered token, f. means for causing said tokens to remain in the space selected on said game board;

wherein in playing the game, numbered tokens are selected by said random selection means and placed in each of said spaces of said game board in a manner whereby the numbers provide a numerical solution of 38 when the numbers are added in all 16 directions in each row, each column, each diagonal, or any four numbers in a square.

2. A game according to claim 1, wherein said game board is contained in the bottom portion of a hinged box container means, said box container means containing a bottom portion containing the game board and a hinged top portion adapted to fold over and completely enclose the bottom portion and game board.

3. A game according to claim 1, wherein said game board is contained within a book-type container, said book-type container being defined by a bottom portion containing the game board and a hinged top portion adapted to fold over and completely cover said bottom portion containing the game board.

4. A game according to claim 1, wherein said selection means comprises means to select the numbered tokens in appropriate order, said selector means comprising a base, spinner means thereon and disc means containing the numbers 2–17 thereon, and circular recessed means for reception of said disc means.

5. A game according to claim 4, wherein said tokens are about 1¼ inches square and contain 1 inch magnets on the reverse side thereof, said magnets being attracted by a magnet of the same size but of opposite polarity attached to each of the squares on the game board.

6. A game according to claim 1, wherein each of said sixteen spaces on said game board is provided with magnet means and said numbered tokens are provided with magnet means on the reverse side from the numbers, said magnets being of opposite polarities so that the numbered token will remain in place on the space selected.

7. A game board according to claim 1, wherein each space on said game board is provided with a recessed portion adapted to receive a numbered token, said token having on its reverse side a peg means adapted to be placed within the recessed portion of the playing space so as to retain the numerical token thereon when played.

8. A game according to claim 1, wherein the numbers 2–17 on said numbered tokens are printed thereon.

9. A game according to claim 1, wherein the numbers on said numbered tokens are carved thereon.

10. A game according to claim 1, wherein said game board and said tokens are constructed of a member selected from the group consisting of wood, plastic and cardboard.

* * * * *